United States Patent [19]

Rubin

[11] 4,004,305

[45] Jan. 25, 1977

[54] SLEEPER SOFA AND MATTRESS COMBINATION

[75] Inventor: Arnold D. Rubin, Highland Park, Ill.

[73] Assignee: Schnadig Corporation, Chicago, Ill.

[22] Filed: Apr. 2, 1976

[21] Appl. No.: 673,086

[52] U.S. Cl. ..... 5/352; 5/13; 5/345 R; 5/DIG. 2

[51] Int. Cl.[2] ..... A47C 17/14; A47C 28/08

[58] Field of Search ..... 5/13, 28, 29, 38, 345 R, 5/352, 357, DIG. 2

[56] References Cited

UNITED STATES PATENTS

| | | | |
|---|---|---|---|
| 2,119,706 | 6/1938 | Drexler et al. | 5/352 |
| 3,166,768 | 1/1965 | Cunningham | 5/DIG. 2 |
| 3,419,920 | 1/1969 | Maddux, Jr. et al. | 5/345 R |
| 3,710,402 | 1/1973 | Eakins | 5/13 |

*Primary Examiner*—Casmir A. Nunberg
*Attorney, Agent, or Firm*—Tilton, Fallon, Lungmus, Chestnut & Hill

[57] ABSTRACT

A sleeper sofa includes an inner spring mattress which has hingedly connected head and foot sections. The hinge permits the mattress to be folded between a sleeping position in which the two sections extend horizontally and a sitting position in which the foot section is folded on top of the head section. The springs of the head section have less compressibility than the springs of the foot section so that the head section is relatively firm and the foot section is relatively soft. When the foot and head sections are in their sleeping positions, the relatively firm head section supports the torso of a person resting on the mattress and provides firm, comfortable sleeping support. When the foot section is folded to the sitting position, the relatively soft foot section provides good sitting comfort.

6 Claims, 6 Drawing Figures

SLEEPER SOFA AND MATTRESS COMBINATION

BACKGROUND AND SUMMARY

This invention relates to sleeper sofas, and, more particularly, to a sleeper sofa which includes a hinged mattress which provides relatively firm sleeping support and relatively soft sitting support.

Sleeper sofas commonly include a folding mattress frame and a mattress which is supported by the frame. When the sleeper sofa is used as a bed, the mattress frame extends horizontally outwardly from the sofa frame, and the mattress is supported on top of the mattress frame. The sleeper sofa can be used as a conventional sofa by folding the mattress frame and mattress and then sliding the folded mattress and mattress frame into the sofa frame. One or more seat cushions are then placed on top of the folded mattress to give the sleeper sofa the appearance of a conventional sofa.

While sleeper sofas have been available for many years, certain disadvantages remain. One of the important disadvantages is that a sleeper sofa is usually not as comfortable as a bed for sleeping and is not as comfortable as a sofa for sitting.

Most people find that a relatively firm mattress which provides good body support provides better sleeping comfort than a relatively soft mattress. However, a relatively soft cushion generally provides better sitting comfort. Accordingly, a mattress for a sleeper sofa which provides maximum sleeping comfort does not provide maximum sitting comfort, and a mattress which provides maximum sitting comfort does not provide maximum sleeping comfort.

The invention provides a sleeper sofa with maximum comfort for either sleeping or sitting by using an inner spring mattress which has two hingedly connected portions. A head portion, which supports the torso of the sleeping person, includes relatively stiff springs to provide firm support and good sleeping comfort, and a foot section, which supports only the lower legs of a sleeping person, uses more compressible springs which provide a soft cushion when the mattress is folded and the sleeper sofa is used as a sofa. Accordingly, maximum comfort is obtained for both sleeping and sitting, and the hinge connection between the head and foot portions permits the mattress to be folded without bulging.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
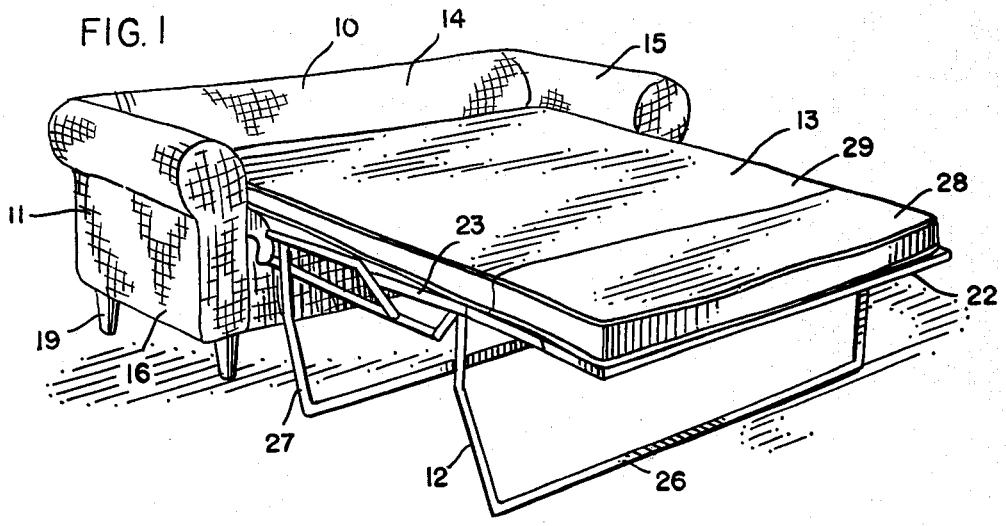
FIG. 1 is a perspective view of a sleeper sofa embodying the invention which is shown in the sleeping position.
Figure 2:
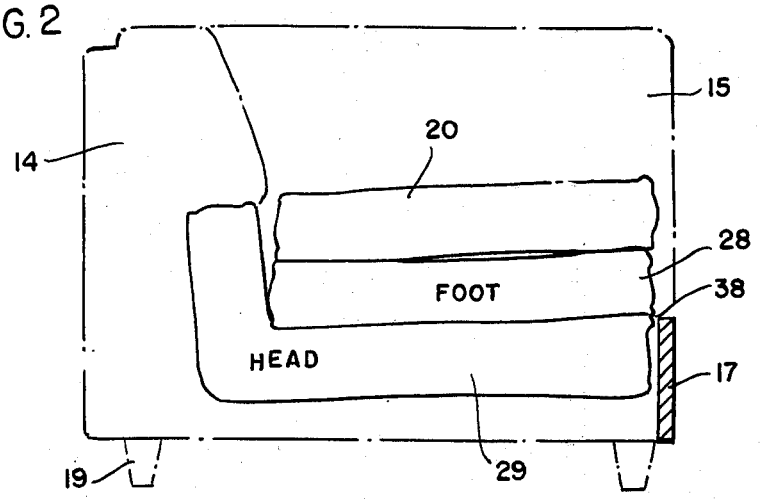
FIG. 2 is a schematic sectional view illustrating the sleeper sofa in a sitting position.

Referring first to FIGS. 1 and 2, a sleeper sofa 10 includes a sofa frame 11, a mattress frame 12, and a mattress 13. The sofa frame includes a back 14, a pair of arms 15 and 16, a front board 17, and a deck 18 which is supported by legs 19. The mattress frame and mattress are foldable between a sleeping position illustrated in FIG. 1 in which the mattress frame and mattress extend horizontally from the sofa frame and a sitting position illustrated in FIG. 2 in which the mattress frame and mattress are folded and positioned within the confines of the sofa frame. A seat cushion 20 is positioned over the folded mattress when the sleeper sofa is used as a sofa.

Figure 3:
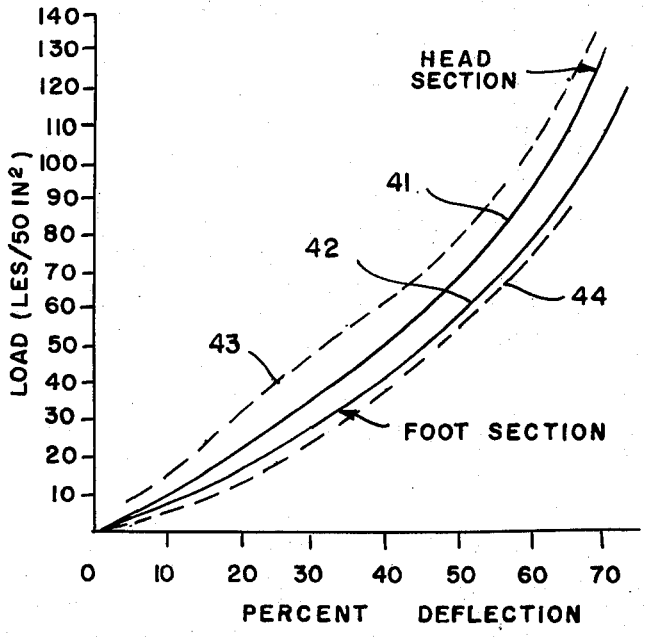
FIG. 3 is a fragmentary sectional view showing the mattress frame and the mattress in their sleeping positions.

The mattress frame is a conventional folding mattress frame used for sleeper sofas, and the details of the construction and operation thereof are well known. The frame includes a generally U-shaped foot section 22 (see also FIG. 3) and a longer head section 23. The head and foot sections are both pivotally connected to a link 24, and the forward end of the head section is pivotally connected to a parallelogram link mechanism designated generally by the numeral 25 which permits the head section to be pivoted forwardly and downwardly into the area between the back of the sofa frame and the front board 17. When the mattress frame is in the sleeping position illustrated in FIGS. 1 and 3, the foot section is supported by a support leg 26 which is pivotally connected thereto, and the head section is supported by a support leg 27 in addition to the link mechanism 25. Conventional wire supports extend across the head and foot sections of the mattress frame for supporting the mattress.

Figure 4:
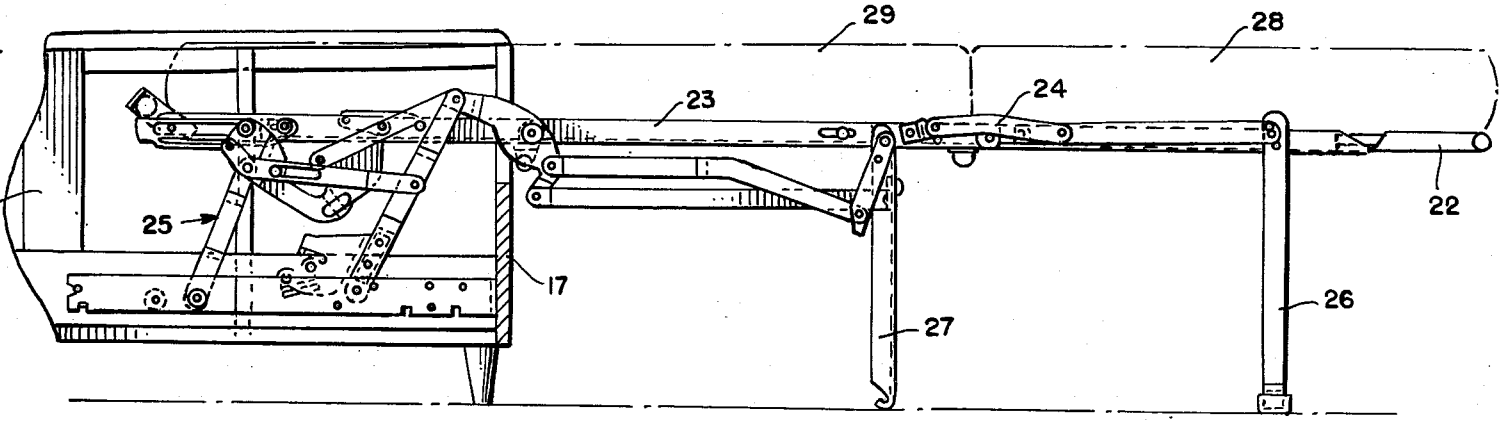
FIG. 4 is a longitudinal fragmentary sectional view of the mattress.

The mattress 13 comprises two separate sections, a relatively short foot section 28 and a longer head section 29. As can be seen best in FIG. 4, each of the mattress sections 28 and 29 are formed in the conventional manner. The foot section 28 includes an outer fabric cover 30, a bottom mat 31, a plurality of coil springs 32 which are attached to the bottom mat, and a foam cushion 33 which extends upwardly from the bottom mat and surrounds the springs. The head section 29 similarly includes an outer cover 34, a bottom mat 35, coil springs 36, and a foam cushion 37. However, the coil springs 32 of the foot section are more compressible than the coil springs 36 of the head section, i.e., the coil springs 32 will compress more under a given load than the coil springs 36. The foot section 28 of the mattress therefore provides a relatively soft and cushiony support while the head section 29 of the mattress provides a relatively firm support.

The two mattress sections are hingedly secured by a fabric flap hinge 38 which extends between the forward end of the foot section and the rearward end of the head section at the upper surfaces thereof and is sewn thereto. The flap hinge permits the mattress sections to be folded freely through 180° from their sleeping positions in which the two sections extend horizontally in the same plane to the sitting position illustrated in FIG. 2 in which the foot section overlies the rear portion of the head section.

The foot section of the mattress is folded over the rear portion of the head section when the foot section of the mattress frame is folded into its storage or sitting position by pivoting the foot section of the frame and the link 24 upwardly until the link 24 extends generally vertically and the foot section of the frame extends generally horizontally toward the sofa frame above the folded mattress sections. The flap hinge 38 which connects the mattress sections permits the confronting surfaces of the mattress to lie flat against each other without bulging, and the length of the link 24 can be approximately the same as the total thickness of both mattress sections. Thereafter, the folded mattress and mattress frame can be pivoted about the parallelogram link mechanism 25 to position the mattress frame and mattress within the sofa frame. In the particular embodiment illustrated in FIG. 2, the forward portion of the head section of the mattress is folded upwardly when the mattress is in the sitting position.

Figure 5:
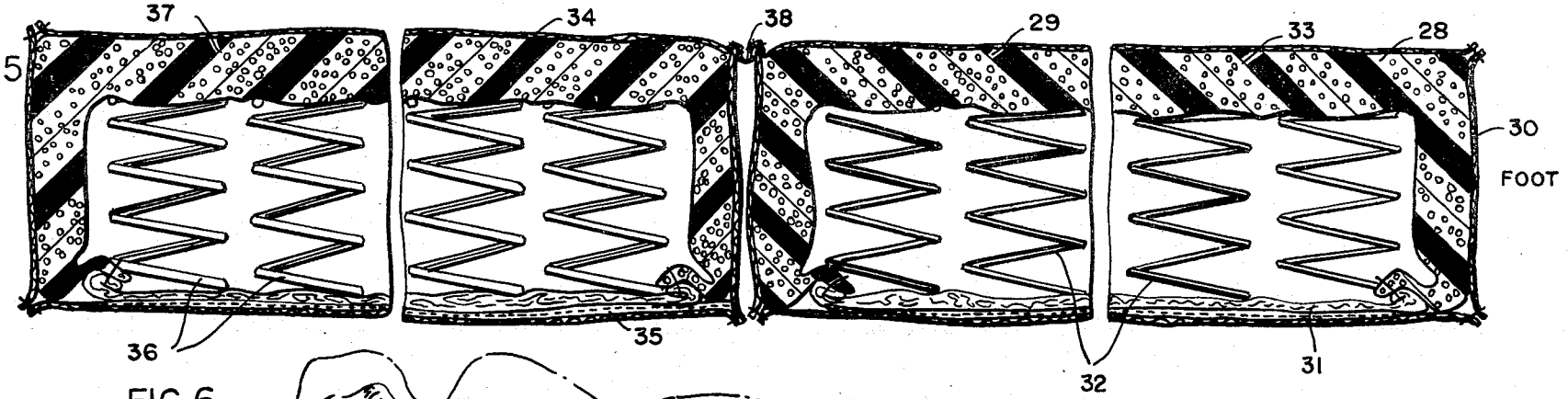
FIG. 5 is a longitudinal sectional view showing the mattress supporting a sleeping person.

FIG. 5 illustrates the mattress when the sofa sleeper is being used as a bed. The head section 29 of the mattress supports the torso, arms, and head of the user as well as a portion of the legs, and the foot portion supports only the lower portions of the legs. The coil springs 36 of the head section are selected to provide firm support for the body and therefore maximum sleeping comfort. On the other hand, the coil springs 32 of the foot section are more compressible and are selected to provide maximum sitting comfort when the mattress is in the folded, sitting position. Since the foot section of the mattress is required to support only the lower portions of the legs of the user when the mattress is in the sleeping position, the springs of the foot section need not support a substantial weight during sleeping, and the relatively compressible springs will not detract from the sleeping comfort of the mattress.

The different load bearing abilities of the two mattress sections can be measured by using a test procedure referred to as "ILD (Indentation-Load-Deflection)". This procedure measures loads which are required to be exerted on a rectangular plate having an area of 50 square inches in order to compress a mattress by a certain percentage. The load at any deflection would be reported as pounds-per-50-square inches to produce that deflection, e.g., 25 lbs./50 in.$^2$ at 25% deflection. The mattress is positioned on a flat surface beneath the 50 sq. in. deflector plate. The thickness of the mattress is measured while a one pound load is applied to the deflector plate. The mattress is then preflexed by lowering the deflector plate twice to compress the mattress to 75% of the measured thickness. After waiting 5–7 minutes, the thickness of the mattress is again measured while a one pound load is applied to the deflector plate. The deflector plate is then lowered to compress the specimen 25% of the new measured thickness, the deflector plate is maintained in position for one minute, and the load applied to the deflector plate is measured in pounds. This final load in pounds is known as the 25% ILD per 50 square inches.

Figure 6:
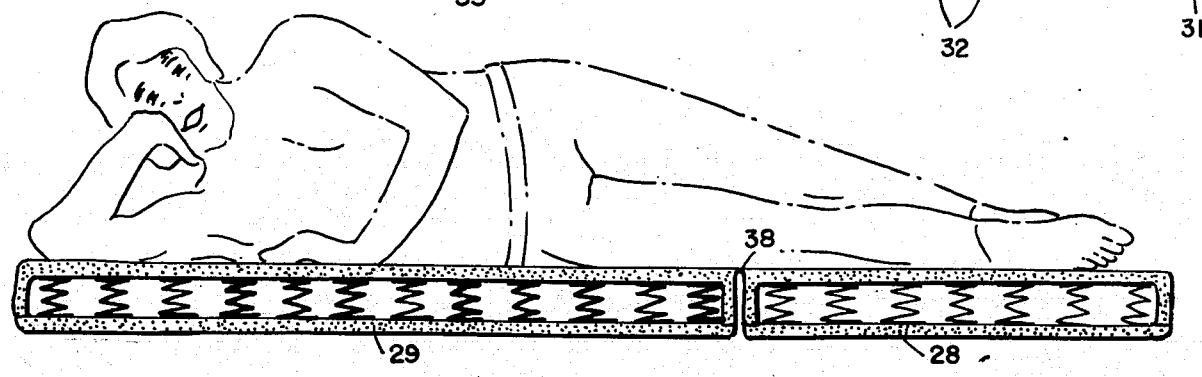
FIG. 6 is a graph showing the load bearing curves for the head and foot sections of the mattress.

Loads were determined for deflections of each of the mattress sections for deflections 0 to 70% for head and foot sections having varying spring compressibility. The comfort of each mattress was determined subjectively from the opinions of both trained and untrained people who sampled the mattresses. The average load bearing curves of ten different mattresses are shown in FIG. 6. The curve designated by the solid line 41 is the average curve for the head sections of the mattresses, and the curve designated by the solid line 42 is the average curve for the foot sections of the mattresses. The two curved dotted lines 43 and 44 define a "zone of comfort" for the head section which is based upon the subjective opinion of the test individuals. Head sections which have a load bearing curve lying within the comfort zone feel more comfortable than head sections which have a load bearing curve which falls outside of the comfort zone.

Another indicator of comfort is modulus. Modulus is defined as the numerical ratio between the ILD at 65% deflection and the ILD at 25%. For example, if a mattress had a 65% ILD of 52 and a 25% ILD of 26, the modulus would be 2.0. The modulus for the average load bearing curve 41 is 3.8, the modulus for the upper limit of the comfort zone represented by the dotted line 43 is 3.0, and the modulus for the lower limit of the comfort zone represented by the dotted line 44 is 4.7. The modulus for the average load bearing curve 42 for the foot sections is 4.3.

While in the foregoing specification a detailed description of a specific embodiment of the invention was set forth for the purpose of illustration, it is to be understood that many of the details hereingiven may be varied considerably by those skilled in the art without departing from the spirit and scope of the invention.

I claim:

1. A sleeper sofa comprising a sofa frame, a folding mattress frame, and a folding spring mattress, the sofa frame having a deck, a pair of arms, and a back, the mattress frame including a head section having a front end and a rear end and a foot section pivotally attached to the rear end of the head section, the head section being pivotally attached to the sofa frame between the arms and being movable between a sleeping position in which the head section extends generally horizontally away from the back of the sofa frame and a sitting position in which the head section is positioned above the deck and between the arms, the foot section being pivotable between a sleeping position in which the foot section extends generally horizontally away from the rear end of the head section and a sitting position in which the foot section overlies a rear portion of the head section, the mattress having a head section which is supported by the head section of the mattress frame and a foot section which is supported by the foot section of the mattress frame and which is hingedly attached to the head section of the mattress, the foot section of the mattress being pivotable with the foot section of the mattress frame between a sleeping position in which the foot section of the mattress is supported by the foot section of the mattress frame and a sitting position in which the foot section of the mattress overlies a rear portion of the head section of the mattress and is supported thereby, the head and foot sections of the mattress being provided with support springs of different compressibility, the springs of the foot section having greater compressibility than the springs of the head section to provide a relatively soft foot section and a relatively firm head section whereby the body of a person is supported primarily by the relatively firm head section of the mattress when the mattress and mattress frame are in their sleeping positions and a person sits on the relatively soft foot section of the mattress when the mattress and mattress frame are in their sitting positions.

2. The sleeper sofa of claim 1 including a seat cushion supported by the foot section of the mattress when the mattress and mattress frame are in their sitting positions.

3. The sleeper sofa of claim 1 in which the modulus of the head section of the mattress is between about 3.0 and about 4.7.

4. The sleeper sofa of claim 1 in which the modulus of the head section of the mattress is about 3.8.

5. The sleeper sofa of claim 1 in which the modulus of the head section of the mattress is about 3.8 and the modulus of the foot section of the mattress is about 4.3.

6. The sleeper sofa of claim 1 in which the hinged attachment between the foot and head sections of the mattress is adjacent the upper surfaces thereof when the foot and head sections are in their sleeping positions.

* * * * *